US011580911B2

(12) United States Patent
Hong et al.

(10) Patent No.: US 11,580,911 B2
(45) Date of Patent: Feb. 14, 2023

(54) DISPLAY DEVICE HAVING A GATE DRIVER COMPENSATION CIRCUIT, AND DRIVING METHOD THEREOF

(71) Applicant: LG Display Co., Ltd., Seoul (KR)

(72) Inventors: Moo Kyoung Hong, Paju-si (KR); Jong Won Yang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/508,651

(22) Filed: Oct. 22, 2021

(65) Prior Publication Data

US 2022/0130336 A1 Apr. 28, 2022

(30) Foreign Application Priority Data

Oct. 23, 2020 (KR) ..... 10-2020-0138483

(51) Int. Cl.
*G09G 3/3266* (2016.01)
*G09G 3/32* (2016.01)
*G09G 3/3208* (2016.01)

(52) U.S. Cl.
CPC ... *G09G 3/3266* (2013.01); *G09G 2310/0264* (2013.01)

(58) Field of Classification Search
CPC ..... G09G 2310/0286
See application file for complete search history.

(56) References Cited

U.S. PATENT DOCUMENTS 9,293,222 B2 * 3/2016 Jang ..... G11C 19/28
11,030,958 B2 6/2021 Chang
2010/0321372 A1 * 12/2010 Iwamoto ..... G09G 3/3677 345/212
2011/0001732 A1 * 1/2011 Morii ..... G09G 3/3677 377/79
2012/0188210 A1 * 7/2012 Zhang ..... G09G 3/3677 345/204
2014/0085285 A1 * 3/2014 Kim ..... G11C 19/28 377/67
2014/0376682 A1 * 12/2014 Jang ..... G11C 19/28 377/64
2015/0302935 A1 * 10/2015 Zeng ..... G09G 3/20 377/64
2016/0012911 A1 * 1/2016 Han ..... G11C 19/28 377/64
2017/0039969 A1 * 2/2017 Wang ..... G09G 3/3648
2017/0206840 A1 * 7/2017 Cho ..... G09G 3/3266
2018/0096645 A1 * 4/2018 Lee ..... G09G 3/20

FOREIGN PATENT DOCUMENTS

KR 10-2016-0078692 A 7/2016
KR 10-2020-0048784 A 5/2020

* cited by examiner

*Primary Examiner* — Sepehr Azari
(74) *Attorney, Agent, or Firm* — Birch, Stewart, Kolasch & Birch, LLP

(57) ABSTRACT

A display device and a driving method thereof are discussed. The display device can include a display panel for displaying images, a scan driver for supplying scan signals to the display panel, and a gate compensation circuit. The gate compensation circuit is configured to respectively sense a first node voltage and a second node voltage from a first node controller and a second node controller of the scan driver, and change a turn-on duty ratio of the first node controller to the second node controller based on the sensed first node voltage and second node voltage.

10 Claims, 17 Drawing Sheets

| | ⓐ / ⓑ | ⓒ | ⓓ | ⓔ | ⓕ |
|---|---|---|---|---|---|
| Initial | 6V/6V | 1.2V/1.2V | 205/205 | 6V/6V | 50%/50% |
| 100Hrs | 5.8V/5.9V | 1.16V/1.18V | 198/201 | 6.2V/6.2V | 49%/51% |
| 200Hrs | 6.0V/6.2V | 1.2V/1.24V | 205/211 | 6.3V/6.3V | 48%/52% |
| ... | | | | | |
| 1000Hrs | 10V/10.6V | 2V/2.16V | 341/368 | 11V/11V | 45%/55% |

DISPLAY DEVICE HAVING A GATE DRIVER COMPENSATION CIRCUIT, AND DRIVING METHOD THEREOF

CROSS-REFERENCE TO RELATED APPLICATIONS

This application claims the priority benefit of Korean Patent Application No. 10-2020-0138483, filed on Oct. 23, 2020 in the Republic of Korea, the entire contents of which are hereby expressly incorporated by reference as if fully set forth herein into the present application.

BACKGROUND OF THE INVENTION

Field of the Invention

The present invention relates to a display device and a driving method thereof.

Discussion of the Related Art

With the development of information technology, the market for display devices that are connection media between users and information is growing. Accordingly, display devices such as a light emitting display device (LED), a quantum dot display device (QDD), and a liquid crystal display device (LCD) are increasingly used.

The aforementioned display devices include a display panel having subpixels, a driver for outputting driving signals for driving the display panel, a power supply for generating power to be supplied to the display panel or the driver, and the like.

These display devices can display images according to the transmission of light or direct emission of light through selected subpixels when driving signals, for example, scan signals and data signals, are provided to the subpixels formed in a display panel of the display device.

SUMMARY OF THE INVENTION

An object of the present invention is to reduce stress due to the extended operation of pull-down transistors included in a scan driver and satisfy turn-on voltage conditions of the pull-down transistors to improve operation reliability and operation stability and compensate for a characteristic deviation between pull-down transistors.

An embodiments of the present invention can provide a display device including a display panel for displaying images, a scan driver for supplying scan signals to the display panel, and a gate compensation circuit for respectively sensing a first node voltage and a second node voltage from a first node controller and a second node controller of the scan driver and changing a turn-on duty ratio of the first node controller to the second node controller based on the sensed first node voltage and second node voltage.

The gate compensation circuit can change levels of a first voltage applied to the first node controller and a second voltage applied to the second node controller based on the sensed first node voltage and second node voltage.

The gate compensation circuit can change at least one of the turn-on duty ratio of the first node controller to the second node controller and a level change rate of the first voltage and the second voltage depending on a degree of deterioration of pull-down transistors controlled by the control of the first node controller and the second node controller.

The gate compensation circuit can include an analog-to-digital converter for converting the sensed first node voltage and second node voltage into digital forms and outputting the first and second node voltages in the digital forms as node voltage sensing values, and a voltage controller for determining deterioration of pull-down transistors based on the node voltage sensing values and generating at least one of a duty change signal and a level change signal depending on a degree of deterioration of pull-down transistors.

The gate compensation circuit can further include a scaler for reducing levels of the sensed first node voltage and second node voltage and then transmitting the first node voltage and the second node voltage to the analog-to-digital converter.

The gate compensation circuit can determine a degree of deterioration of pull-down transistors included in the first node controller and the second node controller based on averages of logic high periods in the sensed first node voltage and second node voltage.

The gate compensation circuit can respectively sense a first gate high voltage and a second gate high voltage for controlling gate electrodes of a first pull-down transistor and a second pull-down transistor included in the scan driver and change a compensation rate depending on a degree of deterioration of the first pull-down transistor and the second pull-down transistor.

The gate compensation circuit can transmit the duty change signal to a level shifter included in the scan driver and transmit the level change signal to a power supply providing a voltage to the level shifter.

In another aspect, an embodiments of the present invention can provide a method of driving a display device, including alternately charging a first gate high voltage and a second gate high voltage in a first node controller and a second node controller of a scan driver, sensing a first node voltage from the first node controller and sensing a second node voltage from the second node controller, determining a degree of deterioration of a first pull-down transistor and a second pull-down transistor included in the scan driver based on the sensed first node voltage and second node voltage, and changing a turn-on duty ratio of the first node controller to the second node controller depending on the degree of deterioration of the first pull-down transistor and the second pull-down transistor.

The step of changing the turn-on duty ratio can include changing levels of the first gate high voltage and the second gate high voltage depending on the degree of deterioration of the first pull-down transistor and the second pull-down transistor.

The step of changing the turn-on duty ratio can include changing at least one of the turn-on duty ratio of the first node controller to the second node controller and a level change rate of the first gate high voltage and the second gate high voltage depending on the degree of deterioration of the first pull-down transistor and the second pull-down transistor.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE EMBODIMENTS

A display device according to various examples of the present invention can be realized by a television system, a video player, a personal computer (PC), a home theater, a vehicle electric apparatus, and a smartphone, but the present invention is not limited thereto. The display device according to the present invention can be realized by a light emitting display device (LED), a quantum dot display device (QDD), a liquid crystal display device (LCD), or the like. However, a light emitting display device that directly emits light based on inorganic light emitting diodes or organic light emitting diodes will be described as an example for convenience of description. Further, all the components of each display device according to all embodiments of the present invention are operatively coupled and configured.

Figure 1:
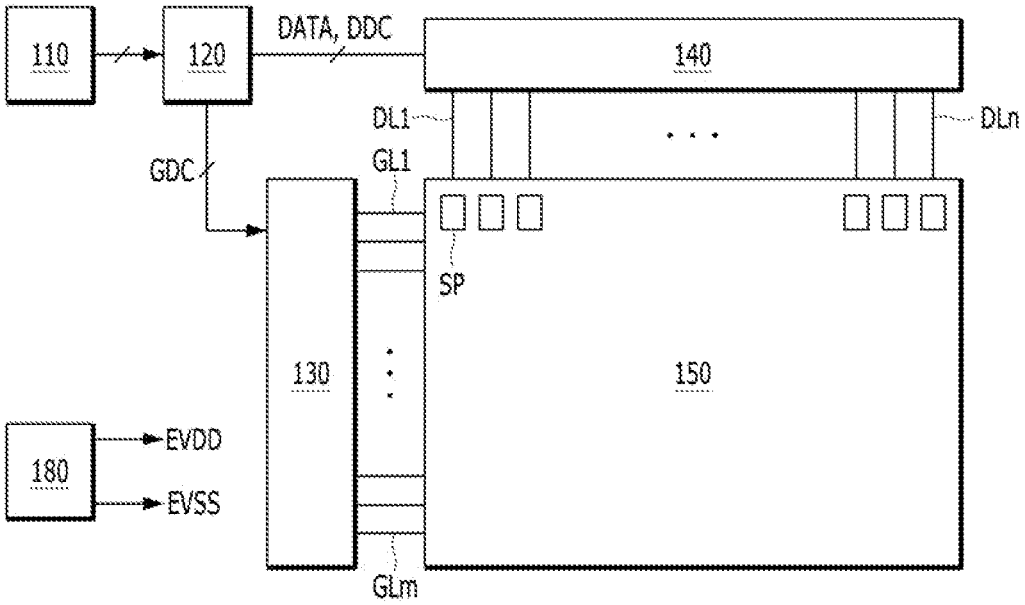
FIG. 1 is a block diagram schematically showing a light emitting display device according to a first embodiment of the present invention.
Figure 2:
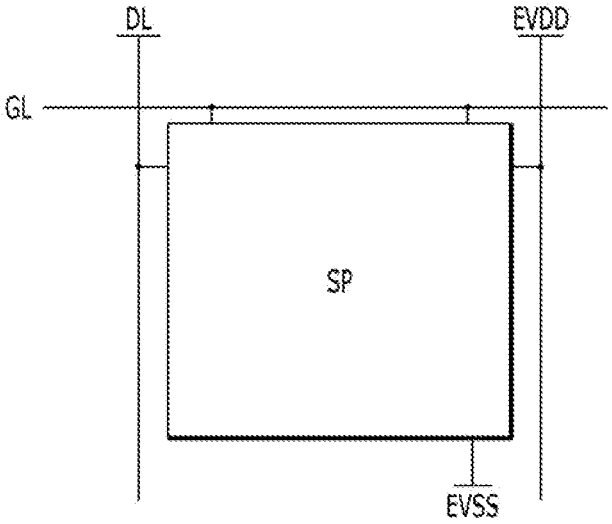
FIG. 2 is a configuration diagram schematically showing a subpixel illustrated in FIG. 1.

FIG. 1 is a block diagram schematically showing a light emitting display device according to a first embodiment of the present invention and FIG. 2 is a configuration diagram schematically showing an example of a subpixel illustrated in FIG. 1.

As illustrated in FIG. 1 and FIG. 2, the light emitting display device according to the first embodiment of the present invention can include an image provider 110, a timing controller 120, a scan driver 130, a data driver 140, a display panel 150, and a power supply 180.

The image provider 110 (or host system) can output various driving signals along with an image data signal supplied from the outside or an image data signal stored in an internal memory. The image provider 110 can provide data signals and various driving signals to the timing controller 120.

The timing controller 120 can output a gate timing control signal GDC for controlling operation timing of the scan driver 130, a data timing control signal DDC for controlling operation timing of the data driver 140, and various synchronization signals (a vertical synchronization signal Vsync and a horizontal synchronization signal Hsync). The timing controller 120 can provide the data timing control signal DDC and a data signal DATA supplied from the image provider 110 to the data driver 140. The timing controller 120 can be formed in the form of an integrated circuit (IC) and mounted on a printed circuit board, but the present invention is not limited thereto.

The scan driver 130 can output a scan signal (or a scan voltage) in response to the gate timing control signal GDC supplied from the timing controller 120. The scan driver 130 can provide the scan signal to subpixels included in the display panel 150 through scan lines GL1 to GLm where m is a positive number such as positive integer. The scan driver 130 can be formed in the form of an IC or directly formed on the display panel 150 in a gate in panel structure, but the present invention is not limited thereto.

The data driver 140 can sample and latch the data signal DATA in response to the data timing control signal DDC supplied from the timing controller 120, convert the data signal in a digital form into a data voltage in an analog form on the basis of a gamma reference voltage, and output the data voltage. The data driver 140 can provide the data voltage to the subpixels included in the display panel 150 through data lines DL1 to DLn where n is a positive number such as positive integer. The data driver 140 can be formed in the form of an IC and mounted on the display panel 150 or mounted on a printed circuit board, but the present invention is not limited thereto.

The power supply 180 can generate a first power at a high voltage and a second power at a low voltage on the basis of an external input voltage supplied from the outside and output the first power and the second power through a first power line EVDD and a second power line EVSS. The power supply 180 can generate and output voltages (e.g., gate voltages including a gate high voltage and a gate low voltage) necessary for operation of the scan driver 130 or voltages (drain voltages including a drain voltage and a half drain voltage) necessary for operation of the data driver 140 as well as the first power and the second power.

The display panel 150 can display an image in response to driving signals including a scan signal and a data voltage, the first power, and the second power. The subpixels of the display panel 150 directly emit light. The display panel 150 can be manufactured based on a rigid or flexible substrate such as a glass substrate, a silicon substrate, or a polyimide substrate. In addition, the subpixels emitting light can include red, green and blue subpixels or red, green, blue, and white subpixels.

For example, a single subpixel SP can include a pixel circuit including a switching transistor, a driving transistor, a storage capacitor, and an organic LED. The subpixel SP used in a light emitting display device has a complicated circuit configuration because it directly emits light. Further, there are various compensation circuits for compensating for deterioration of the driving transistor that provides a driving current to the organic LED as well as the organic LED emitting light. Accordingly, the subpixel SP is simply illustrated in the form of a block.

The timing controller 120, the scan driver 130, and the data driver 140 are described as individual components in the above description. However, one or more of the timing controller 120, the scan driver 130, and the data driver 140 can be integrated into a single IC according to a light emitting display device implementation method.

Figure 3A:
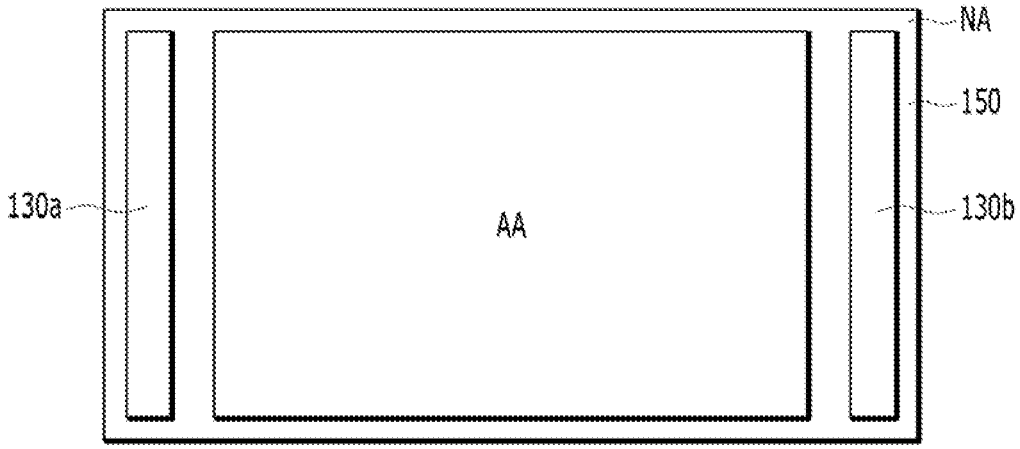
FIG. 3A and FIG. 3B are diagrams showing various examples of arrangement of gate in panel type scan drivers.
Figure 3B:
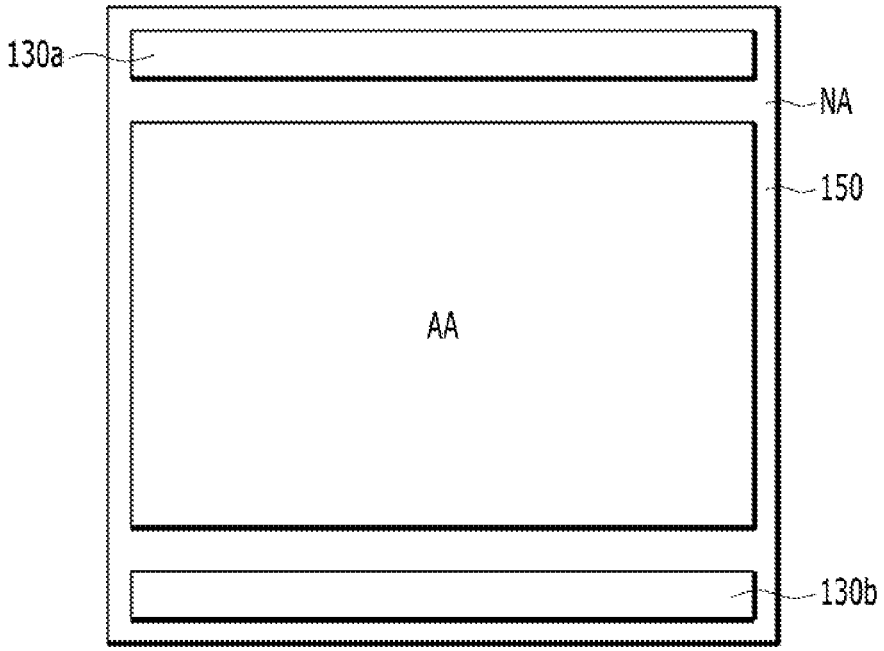
Figure 4:
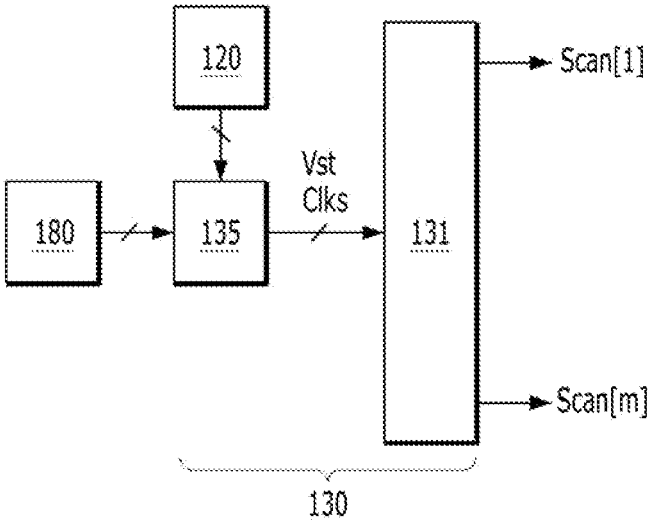
FIG. 4 and FIG. 5 illustrate configurations of devices related to the gate in panel type scan drivers.
Figure 5:
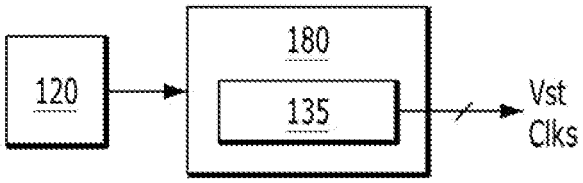
Figure 6:
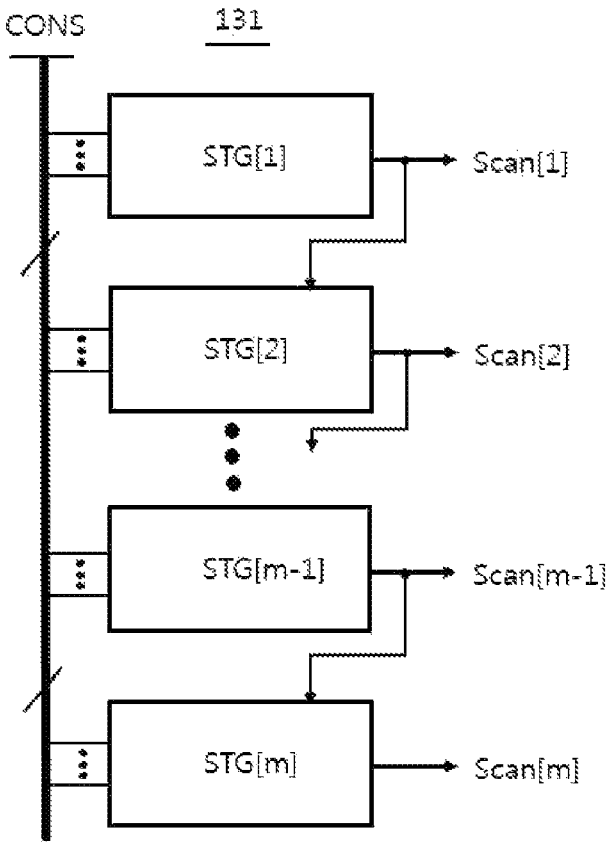
FIG. 6 illustrates a configuration of stages of a shift register.

FIG. 3A and FIG. 3B are diagrams showing examples of arrangement of gate in panel type scan drivers, FIG. 4 and FIG. 5 illustrate configurations of devices related to the gate in panel type scan drivers, and FIG. 6 illustrates a configuration of stages of a shift register.

As illustrated in FIG. 3A and FIG. 3B, the gate in panel type scan drivers 130*a* and 130*b* can be disposed in a non-display area NA of the display panel 150. The scan drivers 130*a* and 130*b* can be disposed in left and right non-display areas NA of the display panel 150, as shown in FIG. 3A. Further or as a variation, the scan drivers 130*a* and 130*b* can be disposed in upper and lower non-display areas NA of the display panel 150, as shown in FIG. 3B.

Although an example in which the scan drivers 130*a* and 130*b* are disposed in the left and right non-display areas NA or the upper and lower non-display areas NA of a display panel 150 has been illustrated and described, only one scan driver can be disposed in the left, right, upper or lower non-display area NA.

As illustrated in FIG. 4, the gate in panel type scan driver 130 can include a shift register 131 and a level shifter 135. The level shifter 135 can generate clock signals Clks and a start signal Vst on the basis of signals and voltages output from the timing controller 120 and the power supply 180. The clock signals Clks can be generated in the form of K-phase (K being an integer equal to or greater than 2) signals having different phases, such as 2 phases, 4 phases, or 8 phases.

The shift register 131 operates on the basis of the signals Clks and Vst output from the level shifter 135 and can output scan signals Scan[1] to Scan[m] for turning on or off transistors formed in the display panel. The shift register 131 can be formed on the display panel in the form of a thin film in a gate in panel structure. Accordingly, a part of the scan driver 130 which is formed on the display panel can be the shifter register 131. In addition, reference numbers 130*a* and 130*b* in FIG. 3A and FIG. 3B can correspond to reference number 131.

As illustrated in FIG. 4 and FIG. 5, the level shifter 135 can be independently formed in the form of an IC differently from the shift register 131 or can be included in the power supply 180. However, this is merely an example and the present invention is not limited thereto.

As illustrated in FIG. 6, the shift register 131 can include a plurality of stages STG[1] to STG[m] that outputs the scan signals Scan[1] to Scan[m] where m can be a positive number such as a positive integer. The stages STG[1] to STG[m] can be connected to control lines CONS that carry signals and voltages. Although the stages STG[1] to STG[m] can have a subordinate connection relation therebetween in order to sequentially output the scan signals Scan[1] to Scan[m], the present invention is not limited thereto.

In the case of the stages STG[1] to STG[m], deterioration of transistors operating to output the scan signals Scan[1] to Scan[m] when the stages STG[1] to STG[m] operate for a long time can cause driving capability deterioration (threshold voltage variation, driving deviation, reliability deterioration, etc.). Accordingly, the following compensation circuit is proposed.

Figure 7:
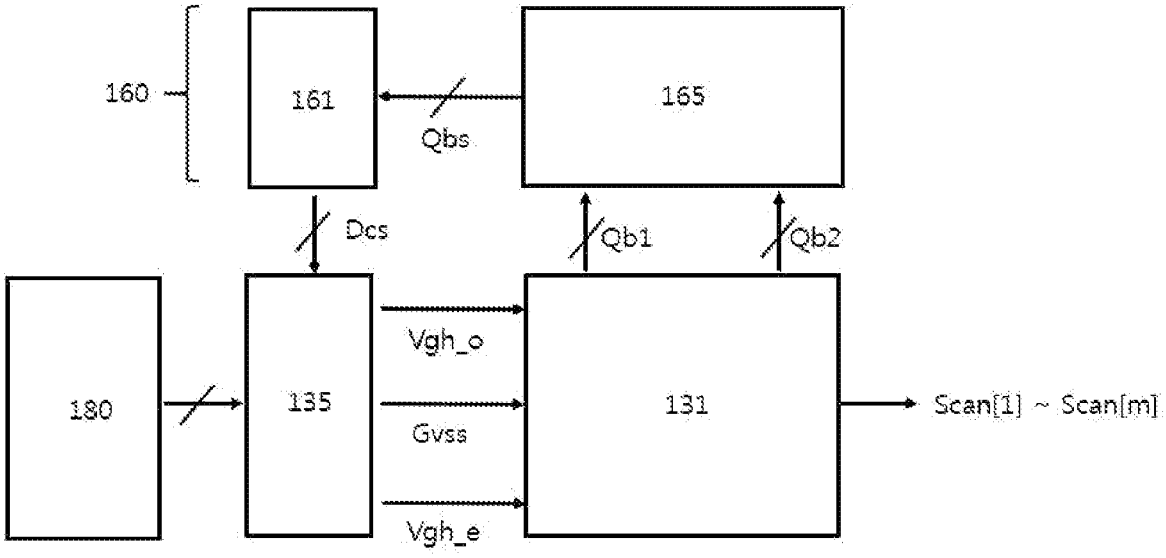
FIG. 7 is a diagram for describing a gate high voltage compensation circuit according to the first embodiment of the present invention.
Figure 8:
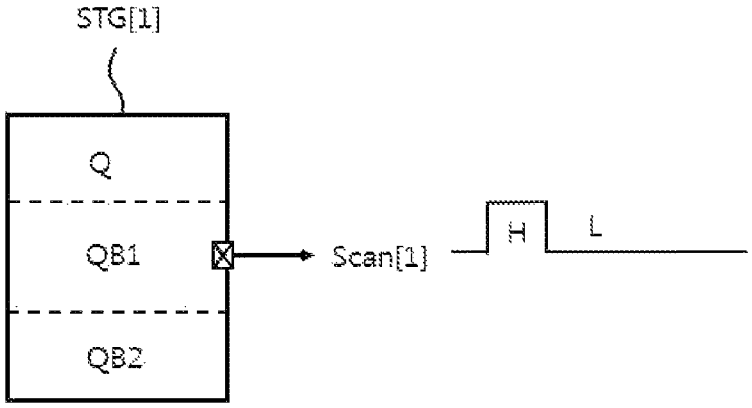
FIG. 8 is a diagram for describing a node controller of a first stage and signal output related to operation thereof.
Figure 9:
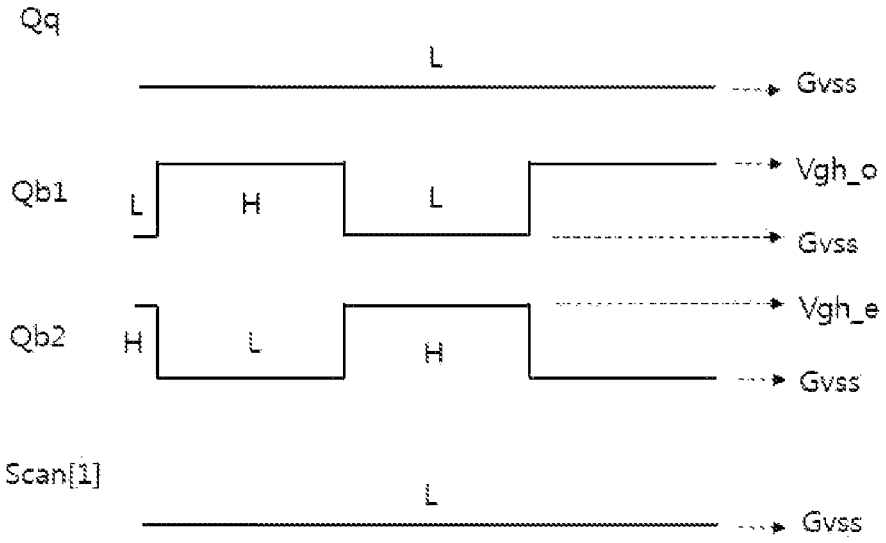
FIG. 9 is a diagram for describing charging/discharging characteristics of the node controller when a logic low scan signal is output.

FIG. 7 is a diagram for describing a gate high voltage compensation circuit according to the first embodiment of the present invention, FIG. 8 is a diagram for describing a node controller of a first stage and signal output related to operation thereof, FIG. 9 is a diagram for describing charging/discharging characteristics of the node controller when a logic low scan signal is output, and FIG. is a diagram for describing a gate high voltage compensation method according to the first embodiment of the present invention.

As illustrated in FIG. 7, the first embodiment of the present invention can include a gate high voltage compensation circuit 160 for compensating for deterioration of pull-down transistors included in the shift register 131 and the level shifter 135.

The gate high voltage compensation circuit 160 can include a node voltage sensor 165 for sensing a node voltage of the shift register 131 and a voltage controller 161 for changing a duty of a gate high voltage output from the level shifter 135.

The node voltage sensor 165 can sense a first QB node voltage Qb1 and a second QB node voltage Qb2 from the shift register 131. The node voltage sensor 165 can convert the first QB node voltage Qb1 and the second QB node voltage Qb2 in analog forms into digital forms and output node voltage sensing values Qbs.

The voltage controller 161 can determine whether the pull-down transistors included in the shift register 131 have deteriorated on the basis of the node voltage sensing values Qbs output from the node voltage sensor 165. Upon determining that the pull-down transistors included in the shift register 131 have deteriorated, the voltage controller 161 can output a duty change signal Dcs for changing the duty of the gate high voltage output from the level shifter 135.

The level shifter 135 can shift levels of a first gate high voltage Vgh_o, a second gate high voltage Vgh_e, and a gate low voltage Gvss necessary for operation of the shift register 131 on the basis of a voltage output from the power supply 180 and output the level-shifted voltages. The level shifter 135 can change duties of the first gate high voltage Vgh_o and the second gate high voltage Vgh_e in response to the duty change signal Dcs output from the voltage controller 161.

The shift register 131 can output the scan signals Scan[1] to Scan[m] on the basis of the first gate high voltage Vgh_o, the second gate high voltage Vgh_e, and the gate low voltage Gvss output from the level shifter 135. Hereinafter, compensation effects according to change in the duty of a gate high voltage will be described on the basis of a single first stage.

As illustrated in FIG. 8, the first stage STG[1] can include a Q node controller Q, a first QB node controller QB1, and a second QB node controller QB2, which are composed of a plurality of transistors. The Q node controller Q, the first QB node controller QB1, and the second QB node controller QB2 are circuits that control the operation of the first stage STG[1].

When the Q node controller Q is charged, the first stage STG[1] can output a first scan signal Scan[1] at a logic high level H. In addition, when one of the first QB node controller QB1 and the second QB node controller QB2 is charged, the first stage STG[1] can output a first scan signal Scan[1] at a logic low level L.

The first stage STG[1] outputs the first scan signal Scan [1] at the logic low level L for a longer time than the first scan signal Scan[1] at the logic high level H, and thus can be more exposed to transistor deterioration. To compensate for this, the first stage STG[1] can have a structure in which a pair of node controllers such as the first QB node controller QB1 and the second QB node controller QB2 is provided and these node controllers are alternately operated. When the first QB node controller QB1 and the second QB node controller QB2 are alternately operated in this manner, transistor deterioration can decrease as compared to a method of operating a single node controller for a long time.

As illustrated in FIG. 8 and FIG. 9, the Q node controller Q can be in a discharged state in response to a Q node voltage Qq corresponding to the logic low level L when the first scan signal Scan[1] at the logic low level L is output from the first stage STG[1].

In addition, the first QB node controller QB1 and the second QB node controller QB2 can be alternately charged and discharged in response to first and second QB node voltages Qb1 and Qb2 that alternate between the logic high level H and the logic low level L when the first scan signal Scan[1] at the logic low level L is output from the first stage STG[1]. For example, when the first QB node controller QB1 is charged in response to the first QB node voltage Qb1, the second QB node controller QB2 can be discharged in response to the second QB node voltage Qb2. On the other hand, when the second QB node controller QB2 is charged in response to the second QB node voltage Qb2, the first QB node controller QB1 can be discharged in response to the first QB node voltage Qb1.

The logic low level L of the Q node voltage Qq, the first QB node voltage Qb1, the second node voltage Qb2, and the first scan signal Scan[1] can be formed by the gate low voltage Gvss. In addition, the logic high level H of the first QB node voltage Qb1 can be formed by the first gate high voltage Vgh_o. Further, the logic high level H of the second QB node voltage Qb2 can be formed by the second gate high voltage Vgh_e.

As can be ascertained from the above description, the first QB node controller QB1 and the second QB node controller QB2 do not use the same gate high voltage and can use separate voltages such as the first gate high voltage Vgh_o and the second gate high voltage Vgh_e. In this manner, a pair of node controllers uses separate gate high voltages instead of the same gate high voltage in consideration of operation characteristics of pull-down transistors under the control of the node controllers because the operation characteristics can be different. Accordingly, initial voltage conditions of the first gate high voltage Vgh_o and the second gate high voltage Vgh_e can be identical or different, and thus a characteristic deviation can occur between the first gate high voltage Vgh_o and the second gate high voltage Vgh_e as operating time increases.

Figure 10:
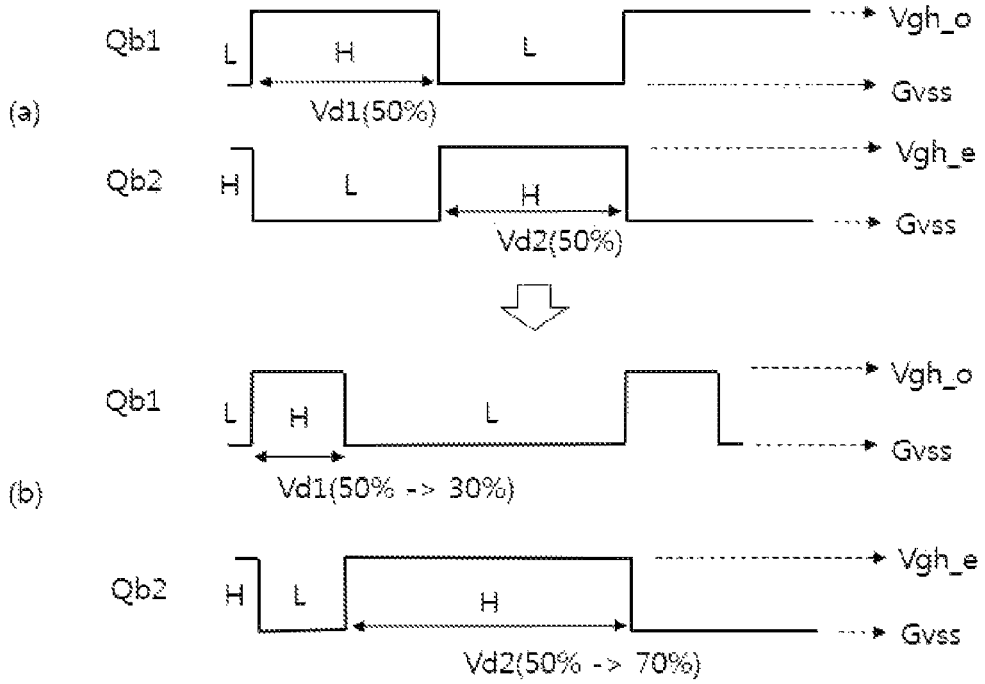
FIG. 10 is a diagram for describing a gate high voltage compensation method according to the first embodiment of the present invention.

Meanwhile, when pull-down transistors under the control of the first QB node controller QB1 and the second QB node controller QB2 maintain a normal threshold voltage (or an initial threshold voltage) without deterioration, a turn-on duty ratio of the pull-down transistors can be set to 50%:50% as indicated by Vd1 and Vd2 shown in portion (a) of FIG. 10.

However, if deterioration of pull-down transistors under the control of the first QB node controller QB1 is more severe than those under the control of the second QB node controller QB2 (or a deterioration rate of QB1 is higher than that of QB2) from a determination result of a sensing operation of the gate high voltage compensation circuit 160, the turn-on duty ratio of the pull-down transistors can change to 30%:70% as indicated by Vd1 and Vd2 shown in portion (b) of FIG. 10.

As can be ascertained through description of FIG. 7 to FIG. 10, the node voltages Qb1 and Qb2 of the first QB node controller QB1 and the second QB node controller QB2 can be sensed on the basis of the gate high voltage compensation circuit 160 in the first embodiment of the present invention. Further, it is possible to determine pull-down transistors that have further deteriorated between pull-down transistors under the control of the first QB node controller QB1 and pull-down transistors under the control of the second QB node controller QB2. In addition, it is possible to change a duty (minimize a turn-on time of a deteriorated node controller) in order to reduce stress of the relatively severely deteriorated pull-down transistors.

Figure 11:
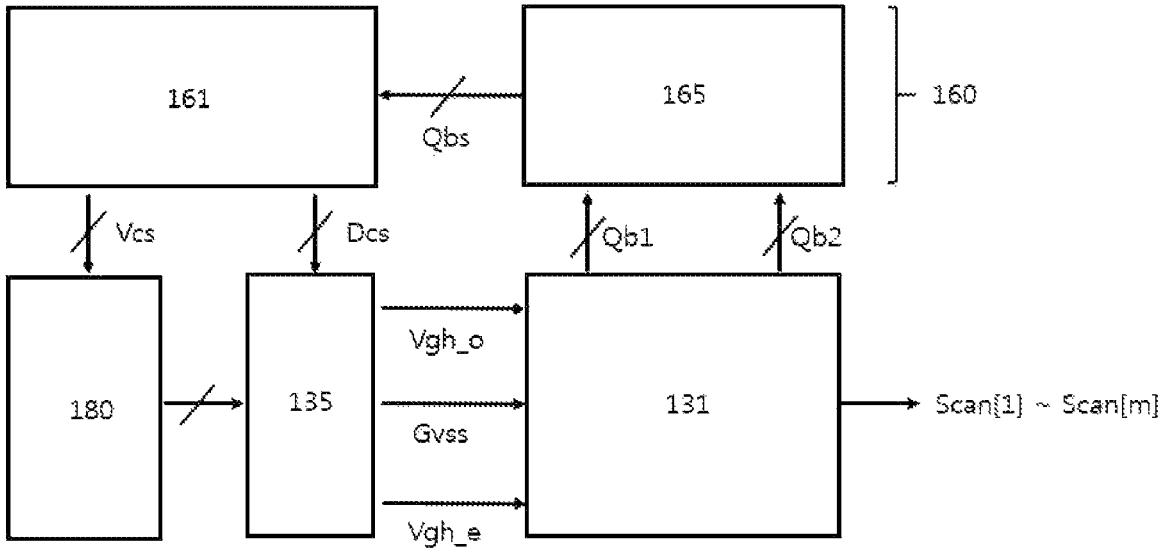
FIG. 11 is a diagram for describing a gate high voltage compensation circuit according to a second embodiment of the present invention.
Figure 12:
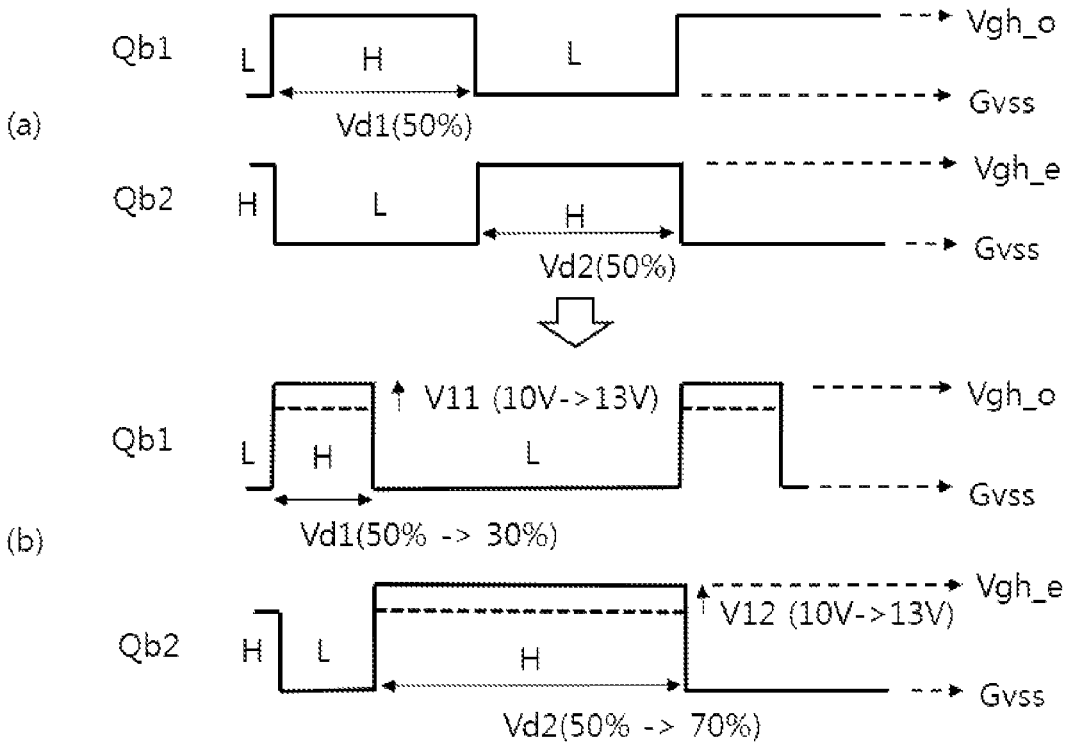
FIG. 12 is a diagram for describing a gate high voltage compensation method according to the second embodiment of the present invention.

FIG. 11 is a diagram for describing a gate high voltage compensation circuit according to a second embodiment of the present invention and FIG. 12 is a diagram for describing a gate high voltage compensation method according to the second embodiment of the present invention.

As illustrated in FIG. 11, the second embodiment of the present invention can include the gate high voltage compensation circuit 160 for compensating for deterioration of pull-down transistors included in the shift register 131 and the level shifter 135. Since the gate high voltage compensation circuit 160 according to the second embodiment differs from the gate high voltage compensation circuit 160 according to the first embodiment in that the former can control the power supply 180 along with the level shifter 135, description will focus on this difference.

The gate high voltage compensation circuit 160 can include a node voltage sensor 165 that senses a node voltage of the shift register 131 and a voltage controller 151 that changes a duty of a gate high voltage output from the level shifter 135 and changes a level of a gate high voltage output from the power supply 180.

The node voltage sensor 165 can sense a first QB node voltage Qb1 and a second QB node voltage Qb2 from the shift register 131. The node voltage sensor 165 can convert the first QB node voltage Qb1 and the second QB node voltage Qb2 in analog forms into digital forms and output the first QB node voltage Qb1 and the second QB node voltage Qb2 in the digital forms as node voltage sensing values Qbs.

The voltage controller 161 can determine deterioration of pull-down transistors included in the shift register 131 on the basis of the node voltage sensing values Qbs output from the node voltage sensor 165. The voltage controller 161 can output a duty change signal Dcs for changing the duty of the gate high voltage output from the level shifter 135 upon determining that the pull-down transistors included in the shift register 131 have deteriorated. Further, the voltage controller 161 can output a level change signal Vcs for changing the level of the gate high voltage output from the power supply 180 upon determining that the pull-down transistors included in the shift register 131 have deteriorated.

The power supply 180 can output the first gate high voltage Vgh_o, the second gate high voltage Vgh_e, and the gate low voltage Gvss. The power supply 180 can change the levels of the first gate high voltage Vgh_o and the second gate high voltage Vgh_e in response to the level change signal Vcs output from the voltage controller 161.

The level shifter 135 can shift the levels of the first gate high voltage Vgh_o, the second gate high voltage Vgh_e, and the gate low voltage Gvss necessary for the operation of the shift register 131 on the basis of the voltages output from the power supply 180 and output the level-shifted voltages. The level shifter 135 can change duties of the first gate high voltage Vgh_o and the second gate high voltage Vgh_e in response to the duty change signal Dcs output from the voltage controller 161.

Meanwhile, when pull-down transistors under the control of the first QB node controller QB1 and the second QB node controller QB2 maintain a normal threshold voltage (or an initial threshold voltage) without deterioration, a turn-on duty ratio of the pull-down transistors can be set to 50%:50% as indicated by Vd1 and Vd2 shown in portion (a) of FIG. 12.

However, if deterioration of pull-down transistors under the control of the first QB node controller QB1 is more severe than those under the control of the second QB node controller QB2 (or a deterioration rate of QB1 is higher than that of QB2) from a determination result of a sensing operation of the gate high voltage compensation circuit 160, the turn-on duty ratio of the pull-down transistors can change to 30%:70% as indicated by Vd1 and Vd2 shown in portion (b) of FIG. 12. Further, the levels of the first gate high voltage Vgh_o and the second gate high voltage Vgh_e can be boosted from 10 V to 13 V as indicated by V11 and V12 shown in portion (b) of FIG. 12.

As can be ascertained through description of FIG. and FIG. 12, it is possible to change duties of node controllers QB1 and QB2 (minimize a turn-on time of a deteriorated node controller) in order to reduce stress of severely deteriorated pull-down transistors in the second embodiment of the present invention. In addition, it is possible to change the levels of the first gate high voltage Vgh_o and the second gate high voltage Vgh_e depending on deterioration of pull-down transistors.

When the levels of the first gate high voltage Vgh_o and the second gate high voltage Vgh_e are boosted in this manner, turn-on voltage conditions of the pull-down transistors under the control of the first QB node controller QB1 and the second QB node controller QB2 can be satisfied (conditions for insufficient turn-on voltage according to threshold voltage shift of transistors are resolved). Accordingly, when both the levels of the first gate high voltage Vgh_o and the second gate high voltage Vgh_e are changed, it is possible to reduce stress of severely deteriorated pull-down transistors and satisfy turn-on voltage conditions to improve operation reliability and operation stability. For reference, operation reliability can depend on a severely deteriorated transistor between a pair of pull-down transistors.

Figure 13:
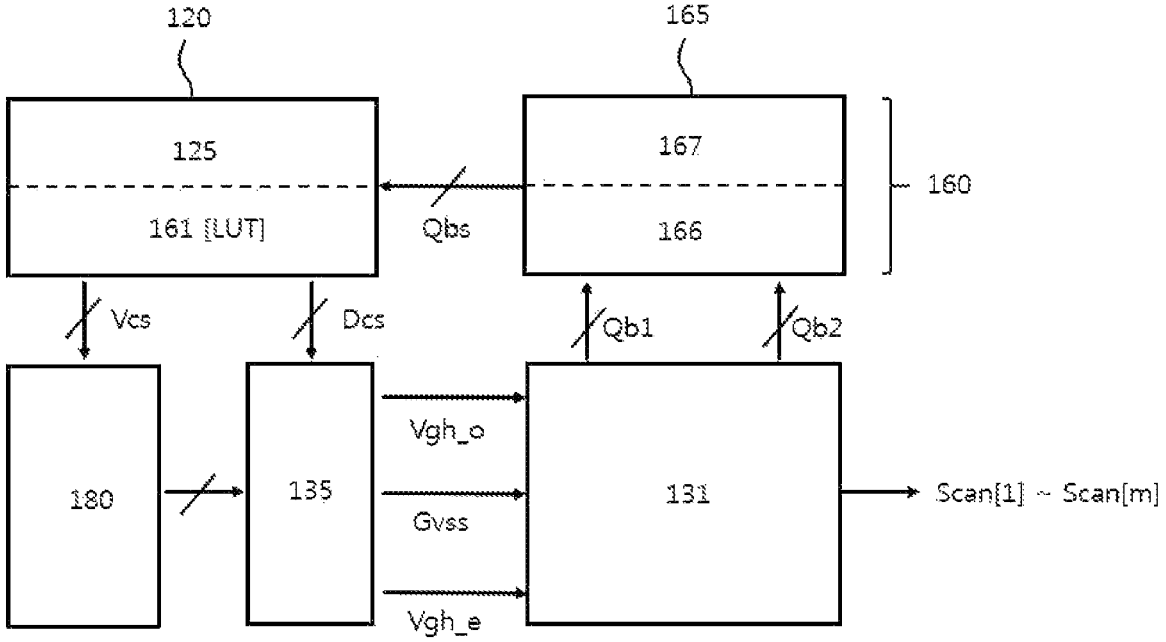
FIG. 13 is a diagram for describing a gate high voltage compensation circuit according to a third embodiment of the present invention.
Figure 14:
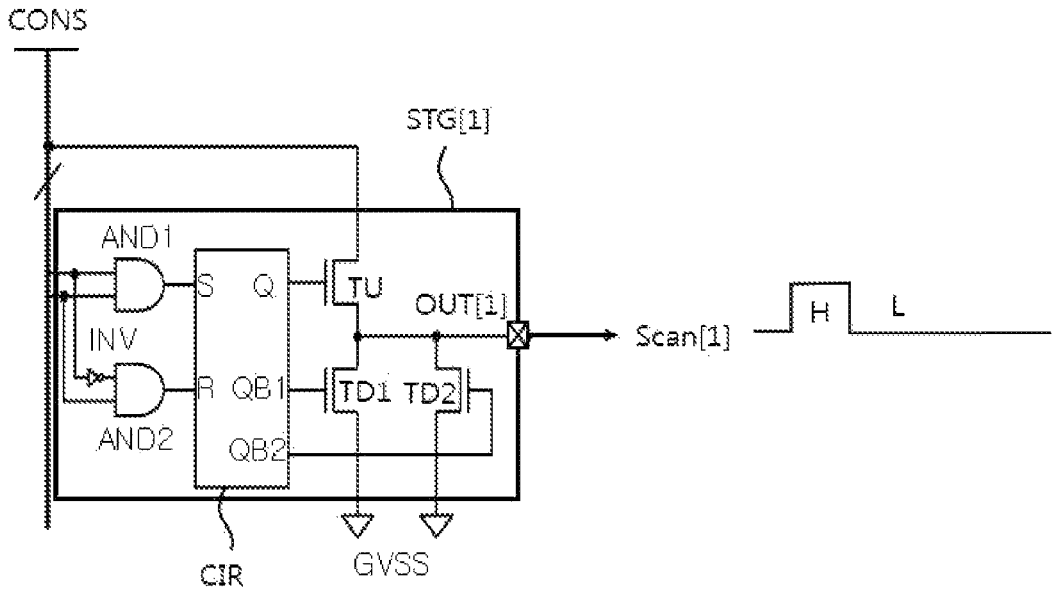
FIG. 14 is a diagram schematically showing a configuration of a first stage.
Figure 15:
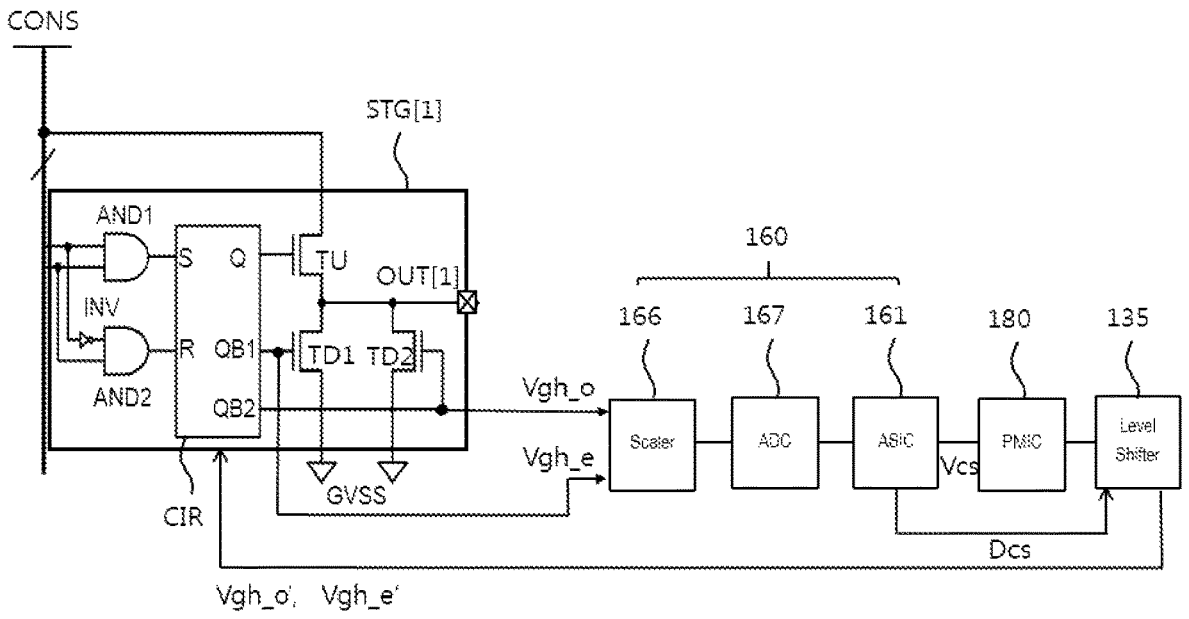
FIG. 15 is a diagram showing a gate high voltage compensation circuit realized by the first stage illustrated in FIG. 14.

FIG. 13 is a diagram for describing a gate high voltage compensation circuit according to a third embodiment of the present invention, FIG. 14 is a diagram schematically showing a configuration of a first stage, FIG. 15 is a diagram showing a gate high voltage compensation circuit realized by the first stage illustrated in FIG. 14, and FIG. is a diagram for describing sensing and deterioration determination of the compensation circuit.

As illustrated in FIG. 13, the third embodiment of the present invention can include the gate high voltage compensation circuit 160 for compensating for deterioration of pull-down transistors included in the shift register 131 and the level shifter 135. Since the gate high voltage compensation circuit 160 according to the third embodiment differs from that of the second embodiment with respect to a detailed configuration for controlling the power supply 180 along with the level shifter 135, description will focus on this difference.

The gate high voltage compensation circuit 160 can include a node voltage sensor 165 that senses a node voltage of the shift register 131 and a voltage controller 151 that changes a duty of a gate high voltage output from the level shifter 135 and changes a level of a gate high voltage output from the power supply 180.

The node voltage sensor 165 can sense a first QB node voltage Qb1 and a second QB node voltage Qb2 from the shift register 131. The node voltage sensor 165 can convert the first QB node voltage Qb1 and the second QB node voltage Qb2 in analog forms into digital forms and output the first QB node voltage Qb1 and the second QB node voltage Qb2 in the digital forms as node voltage sensing values Qbs.

The node voltage sensor 165 can include a scaler 166 and an analog-to-digital converter 167. The scaler 166 can serve to scale down the first QB node voltage Qb1 and the second QB node voltage Qb2 to reduce the levels thereof. When the first QB node voltage Qb1 and the second QB node voltage Qb2 sensed from the shift register 131 have high levels, the first QB node voltage Qb1 and the second QB node voltage Qb2 can deviate from a voltage allowable range of the analog-to-digital converter 167 positioned subsequently to the shift register 131. In view of this, the scaler 166 can scale down (e.g., ⅕ scale down) the first QB node voltage Qb1 and the second QB node voltage Qb2 such that the first QB node voltage Qb1 and the second QB node voltage Qb2 satisfy the voltage allowable range of the analog-to-digital converter 167.

The analog-to-digital converter 167 can serve to convert the first QB node voltage Qb1 and the second QB node voltage Qb2 scaled down by the scaler 166 into digital forms and output the first QB node voltage Qb1 and the second QB node voltage Qb2 in the digital forms as node voltage sensing values Qbs.

The voltage controller 161 can be included in the timing controller 120. The voltage controller 161 can determine deterioration of pull-down transistors included in the shift register 131 on the basis of the node voltage sensing values Qbs output from the node voltage sensor 165. The voltage controller 161 can include a look-up table LUT provided through experiments with respect to methods of determining deterioration of the pull-down transistors included in the shift register 131 and compensating for such deterioration.

Upon determining that the pull-down transistors included in the shift register 131 have deteriorated from analysis results based on the node voltage sensing values Qbs and the look-up table LUT, the voltage controller 161 can generate a duty change signal Dcs for changing a duty of a gate high voltage and a level change signal Vcs for changing a level of a gate high voltage depending on a degree of deterioration.

The timing controller 120 can respectively transmit the duty change signal Dcs and the level change signal Vcs generated from the voltage controller 161 to the level shifter 135 and the power supply 180 by driving a main controller 125. Although the timing controller 120 can respectively transmit the duty change signal Dcs and the level change signal Vcs to the level shifter 135 and the power supply 180 on the basis of an additional control line or communication method, the present invention is not limited thereto.

Although an example in which the level shifter 135 and the power supply 180 are separately configured is illustrated and described in FIG. 13, the level shifter 135 and the power supply 180 can be integrated into a single device, as illustrated and described in FIG. 5. In this case, the duty change signal Dcs and the level change signal Vcs output from the timing controller 120 can be transmitted to the power supply 180.

As illustrated in FIG. 14, the first stage STG[1] can include a first AND gate AND1, an inverter INV, a second AND gate AND2, a node controller CIR, a pull-up transistor TU, a first pull-down transistor TD1, and a second pull-down transistor TD2.

The first AND gate AND1, the inverter INV, and the second AND gate AND2 can be connected to control lines CONS carrying signals and voltages. The first AND gate AND1, the inverter INV, and the second AND gate AND2 can transmit signals applied thereto to a first input terminal S and a second input terminal R of the node controller CIR through the control lines CONS.

The node controller CIR can operate on the basis of the signals applied to the first input terminal S and the second input terminal R. The node controller CIR can include a Q node output terminal Q connected to a Q node, a QB1 node control terminal QB1 connected to a QB1 node, and a QB2 node output terminal QB2 connected to a QB2 node. The node controller CIR can respectively control the Q node, the QB1 node, and the QB2 node on the basis of voltages charged in the Q node output terminal Q, the QB1 node output terminal QB1, and the QB2 node output terminal QB2. Accordingly, the Q node output terminal Q, the QB1 node output terminal QB1, and the QB2 node output terminal QB2 are respectively called a Q node controller Q, a first QB node controller QB1, and a second QB node controller QB2. The Q node controller Q can control the gate electrode of the pull-up transistor TU in response to the Q node voltage, the first QB node controller QB1 can control the gate electrode of the first pull-down transistor TD1 in response to the first QB node voltage, and the second QB node controller QB2 can control the gate electrode of the second pull-down transistor TD2 in response to the second QB node voltage.

The pull-up transistor TU, the first pull-down transistor TD1, and the second pull-down transistor TD2 can be called an output circuit because they serve to output the first scan signal Scan[1] through a first output terminal OUT[1] of the first stage STG[1]. Although FIG. 14 illustrates an example in which the first pull-down transistor TD1 and the second pull-down transistor TD2 are N type pull-down transistors, they can be configured as P type pull-down transistors.

When the pull-up transistor TU is turned on, a clock signal or a gate high voltage applied through the control lines CONS can be output through the first output terminal OUT[1] of the first stage STG[1]. When the pull-up transistor TU is turned on, the first stage STG[1] outputs the first scan signal Scan[1] at a logic high level H.

When one of the first pull-down transistor TD1 and the second pull-down transistor TD2 is turned on, a gate low voltage applied through a gate low voltage terminal (or low voltage terminal) GVSS can be output through the first output terminal OUT[1] of the first stage STG[1]. When one of the first pull-down transistor TD1 and the second pull-down transistor TD2 is turned on, the first stage STG[1] outputs the first scan signal Scan[1] at a logic low level L.

As illustrated in FIG. 15, the scaler (Scale Down) 166 can sense the first QB node voltage Qb1 and the second QB node voltage Qb2 from the first QB node controller QB1 and the second QB node controller QB2 included in the first stage STG[1].

The first pull-down transistor TD1 can be turned on based on the first gate high voltage Vgh_o charged in the first QB node controller QB1 and the second pull-down transistor TD2 can be turned on based on the second gate high voltage Vgh_e charged in the second QB node controller QB2.

The scaler 166 can sense only the first gate high voltage Vgh_o charged in the first QB node controller QB1 and the second gate high voltage Vgh_e charged in the second QB node controller QB2 and then scale down the sensed voltages. The analog-to-digital converter (ADC) 167 can convert the first gate high voltage Vgh_o and the second gate high voltage Vgh_e scaled down by the scaler 166 into digital forms.

The voltage controller 161 can estimate a degree of deterioration of the first pull-down transistor TD1 and the second pull-down transistor TD2 included in the first stage STG[1] on the basis of the first gate high voltage Vgh_o and the second gate high voltage Vgh_e.

Figure 16:
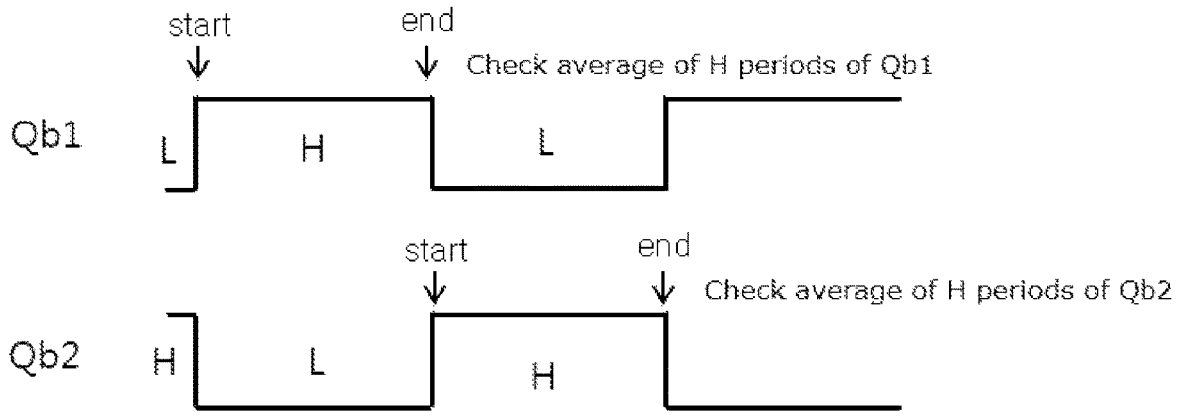
FIG. 16 is a diagram for describing sensing and deterioration determination of the compensation circuit.

As illustrated in FIG. 15 and FIG. 16, the voltage controller 161 can check averages of logic high H periods in the voltages charged in the first QB node controller QB1 and the second QB node controller QB2 on the basis of the sensed first gate high voltage Vgh_o and second gate high voltage Vgh_e.

If the averages of the logic high H periods are ascertained, it is possible to determine or estimate which pull-down transistor has been in an environment causing deterioration and how long the pull-down transistor has been in that environment. The voltage controller 161 can calculate the averages of the logic high H periods on the basis of start points (rising edges) and end points (falling edges) of the sensed first and second gate high voltages Vgh_o and Vgh_e at the logic high level H. For this, the first gate high voltage Vgh_o and the second gate high voltage Vgh_e are sensed in the sensing operation.

The voltage controller (ASIC) 161 can generate the level change signal Vcs for changing the levels of the first gate high voltage Vgh_o and the second gate high voltage Vgh_e in addition to the duty change signal Dcs for changing the duties of the first gate high voltage Vgh_o and the second gate high voltage Vgh_e.

Through the above-described sensing and compensation operations, the first stage STG[1] can compensate for deterioration of the first pull-down transistor TD1 and the second pull-down transistor TD2 on the basis of the changed first gate high voltage Vgh_o' and second gate high voltage Vgh_e'.

Meanwhile, if the pull-down transistors included in the first stage STG[1] are implemented as N type transistors like the first and second pull-down transistors TD1 and TD2, the threshold voltage can be shifted in a negative direction when deterioration of these pull-down transistors occurs. Accordingly, when a deteriorated N type transistor is sensed, a lower voltage than that before deterioration can be sensed. In the present invention, an example of boosting the levels of the first gate high voltage Vgh_o and the second gate high voltage Vgh_e in a state in which the aforementioned characteristic is recognized has been described.

However, if the pull-down transistors included in the first stage STG[1] are implemented as P type transistors, the threshold voltage can be shifted in a positive direction when deterioration of these pull-down transistors occurs. Accordingly, when the pull-down transistors included in the first stage STG[1] are implemented as P type transistors, voltage levels can be reduced in order to satisfy turn-on voltage conditions of these pull-down transistors.

Figure 17:
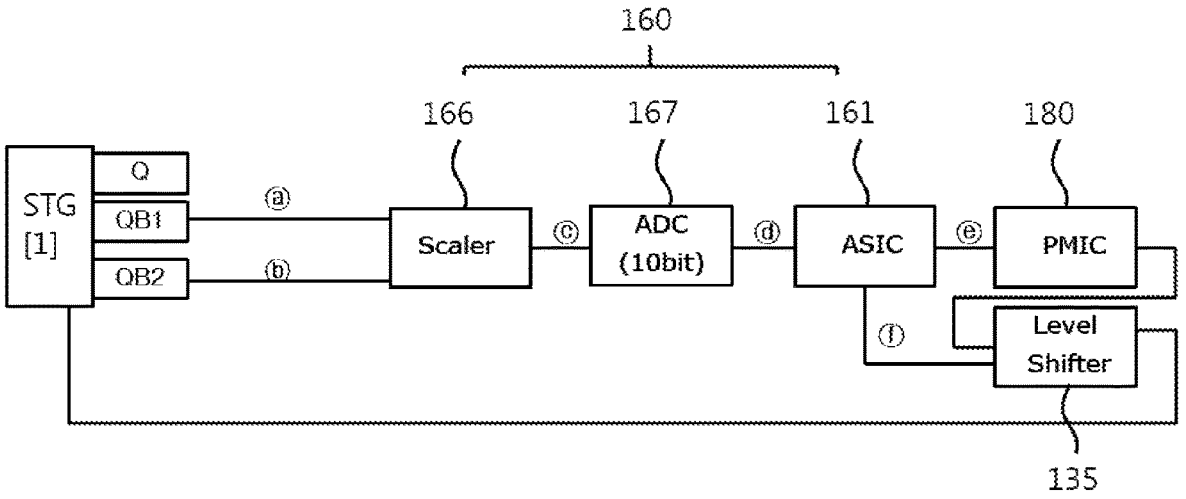
FIG. 17 and FIG. 18 are diagrams illustrating a gate high voltage compensation method according to the third embodiment of the present invention.
Figures 18, 19:
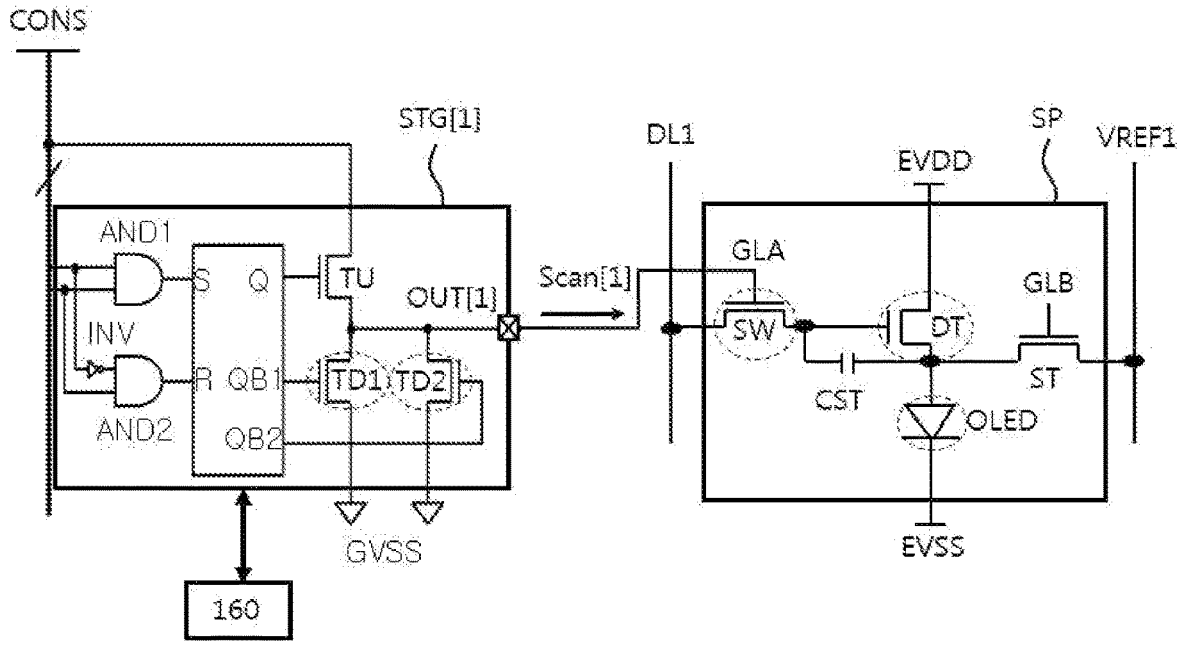
FIG. 19 to FIG. 21 are diagrams for describing compensation effects according to the embodiments of the present invention.

FIG. 17 and FIG. 18 are diagrams illustrating a gate high voltage compensation method according to the third embodiment of the present invention.

Referring to ⓐ to ⓕ of initial reference in FIG. 17 and FIG. 18, the first gate high voltage Vgh_o and the second gate high voltage Vgh_e can both be 6 V, and they can be sensed and scaled down by the scaler 166 to become 1.2 V. Then, the first gate high voltage Vgh_o and the second gate high voltage Vgh_e can be converted into digital forms as indicated by 205/205 through the analog-to-digital converter 167 and transmitted to the voltage controller 161. Then, the voltage controller 161 can maintain the voltage level of 6 V and the duty ratio of 50%/50% without compensating for the voltage level and the duty ratio because the voltage values sensed from the digital forms are identical.

However, referring to ⓐ to ⓕ of 100 hours (Hrs), 200 hours (Hrs), and 1000 hours (Hrs) after the initial reference, the first gate high voltage Vgh_o and the second gate high voltage Vgh_e can change. In addition, the voltage controller 161 can perform compensation of the voltage levels and the duty ratio.

As can be ascertained through compensation data illustrated in FIG. 18, the first pull-down transistor TD1 and the second pull-down transistor TD2 illustrated in FIG. can have an initial characteristic deviation or a characteristic deviation due to operating time increase therebetween. To compensate for this characteristic deviation, the voltage controller 161 can change at least one of a voltage level change rate and the duty ratio. For example, a compensation rate can change depending on a degree of deterioration of the first pull-down transistor TD1 and the second pull-down transistor TD2 illustrated in FIG. 15.

Figure 20:
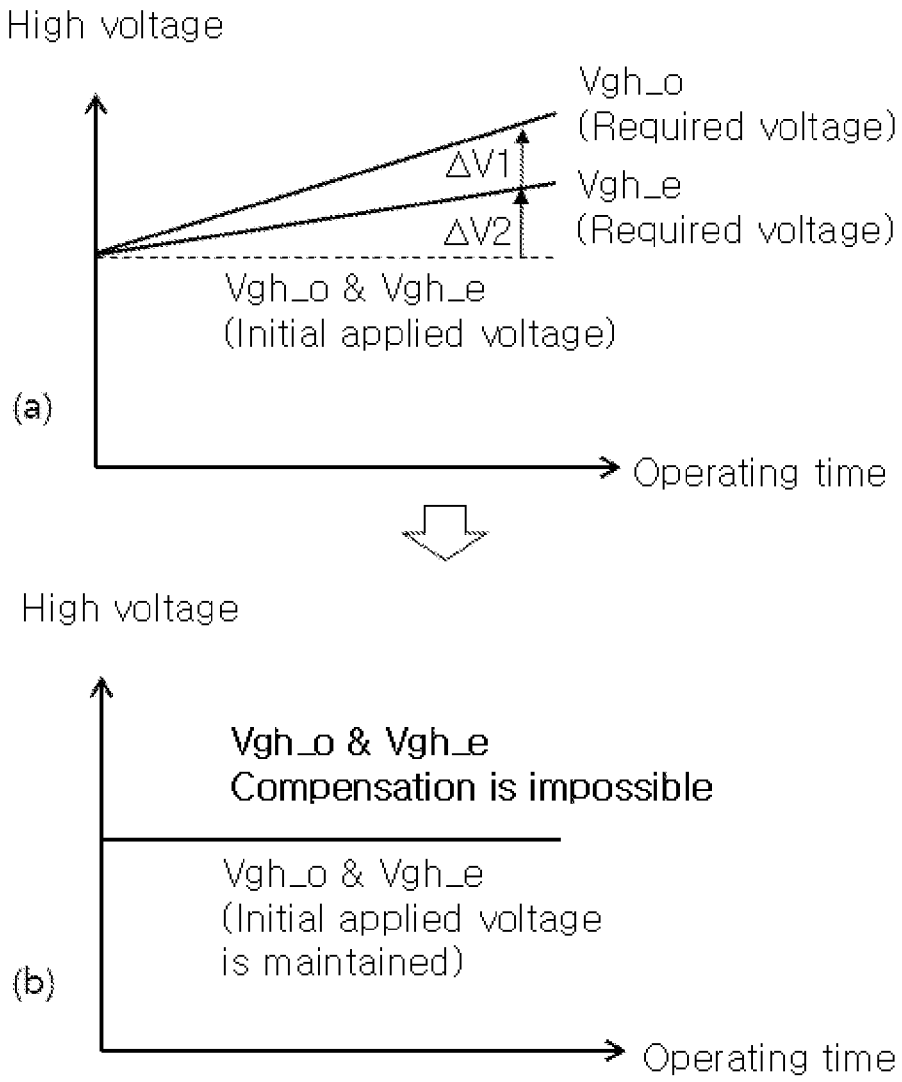
Figure 21:
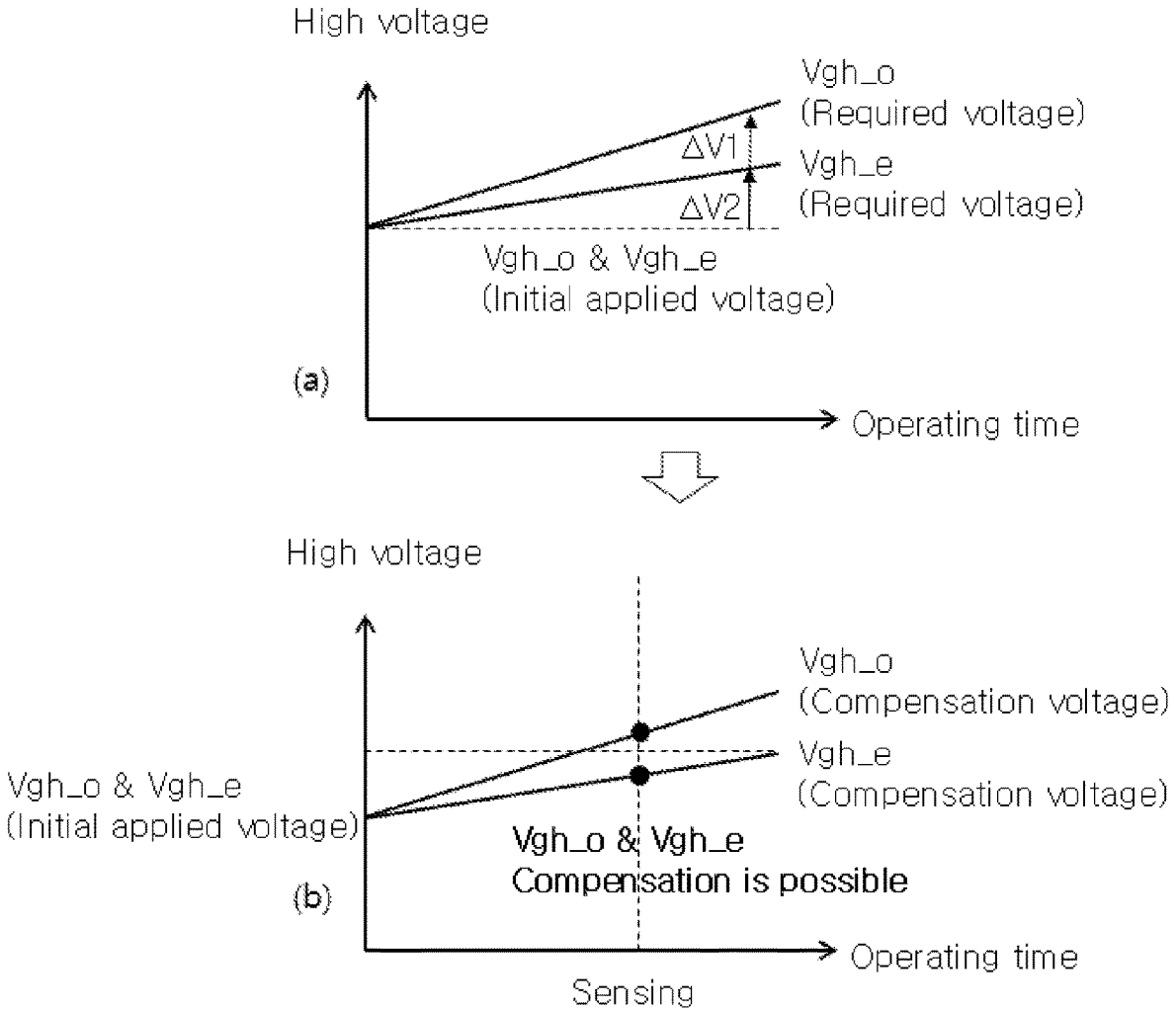

FIG. 19 to FIG. 21 are diagrams for describing compensation effects according to the embodiments of the present invention.

As illustrated in FIG. 19, the embodiments of the present invention can be applied to an external compensation type subpixel SP. The external compensation type subpixel SP can include a switching transistor SW, a capacitor CST, a driving transistor DT, a sensing transistor ST, and an organic light emitting diode OLED.

The switching transistor SW can serve to transfer a data voltage applied through a first data line DL1 to the capacitor CST, the capacitor CST can serve to store the data voltage and then apply the data voltage to the driving transistor DT, the driving transistor DT can serve to generate a driving current, the organic light emitting diode OLED can serve to emit light in response to the driving current, and the sensing transistor ST can serve to sense a deterioration value for compensating for deterioration of the driving transistor DT or the organic light emitting diode OLED and transfer the deterioration value to an external compensation device through a first reference line VREF1.

The external compensation type subpixel SP can compensate for deterioration of at least one of the driving transistor DT and the organic light emitting diode OLED in association with the external compensation device. Here, when the embodiments of the present invention are applied, an indirect compensation effect of the switching transistor SW can also be obtained on the basis of the compensation operation of the gate high voltage compensation circuit 160 for the pull-down transistors TD1 and TD2. This is because the stabilized first scan signal Scan[1] can be output from the first stage STG[1] and thus stability and reliability of the operation of turning off the switching transistor SW can be improved.

As illustrated in portion (a) of FIG. 20 and portion (a) of FIG. 21, the first and second pull-down transistors included in the shift register can deteriorate as operating time increases. As a result, required first and second gate high voltages Vgh_o and Vgh_e used to turn on the first and second pull-down transistors also increase by ΔV1 or ΔV2 from an initial applied voltage as the operating time increases.

As illustrated in portion (b) of FIG. 20, fixed first and second gate high voltages Vgh_o and Vgh_e are used in a conventional structure, and thus an initial applied voltage level is maintained even when operating time increases. For example, the first and second gate high voltages Vgh_o and Vgh_e cannot be compensated in the conventional structure. Furthermore, the initial applied voltage condition for the first and second gate high voltages Vgh_o and Vgh_e needs to be set to a high level in consideration of deterioration of the first and second pull-down transistors in the conventional structure.

However, the first and second gate high voltages Vgh_o and Vgh_e that can be changed on the basis of sensing are used in the embodiments, as illustrated in portion (b) of FIG. 21, and thus the first and second gate high voltages Vgh_o and Vgh_e can be boosted from the initial applied voltage when the operating time increases. For example, the first and second gate high voltages Vgh_o and Vgh_e can be compensated and changed to the same level or different levels depending on deterioration of the first and second pull-down transistors in the embodiments. Furthermore, the initial applied voltage condition for the first and second gate high voltages Vgh_o and Vgh_e can be set to a relatively low level because the voltages can be changed depending on deterioration of the first and second pull-down transistors, and thus stress applied to the transistors can be minimized in the embodiments.

The embodiments of the present invention can reduce stress due to extended operation of pull-down transistors included in the scan driver and satisfy turn-on voltage conditions of the pull-down transistors to improve operation reliability and operation stability. In addition, the embodiments of the present invention can compensate for a characteristic deviation between the pull-down transistors according to a duty changing method of the output circuit included in the scan driver. Furthermore, the embodiments of the present invention can minimize stress applied to the pull-down transistors by setting an initial applied voltage condition to a relatively low level.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display device, comprising:

a display panel configured to display images;

a scan driver configured to supply scan signals to the display panel; and a gate compensation circuit configured to respectively sense a first node voltage and a second node voltage from a first node controller and a second node controller of the scan driver, and change a turn-on duty ratio of the first node controller to the second node controller based on the sensed first node voltage and second node voltage, wherein the gate compensation circuit is configured to determine a degree of deterioration of pull-down transistors included in the first node controller and the second node controller based on averages of logic high periods in the sensed first node voltage and second node voltage.

2. The display device of claim 1, wherein the gate compensation circuit is configured to change levels of a first voltage applied to the first node controller and a second voltage applied to the second node controller based on the sensed first node voltage and second node voltage.

3. The display device of claim 2, wherein the gate compensation circuit is configured to change at least one of the turn-on duty ratio of the first node controller to the second node controller and a level change rate of the first voltage and the second voltage depending on a on the degree of deterioration of pull-down transistors controlled by the control of the first node controller and the second node controller.

4. The display device of claim 2, wherein the gate compensation circuit includes:

an analog-to-digital converter configured to convert the sensed first node voltage and second node voltage into digital forms and output the first and second node voltages in the digital forms as node voltage sensing values, and a voltage controller configured to determine deterioration of pull-down transistors based on the node voltage sensing values and generate at least one of a duty change signal and a level change signal depending on the degree of deterioration of pull-down transistors.

5. The display device of claim 4, wherein the gate compensation circuit further includes:

a scaler configured to reduce levels of the sensed first node voltage and second node voltage and then transmit the first node voltage and the second node voltage to the analog-to-digital converter.

6. The display device of claim 4, wherein the gate compensation circuit is configured to:

transmit the duty change signal to a level shifter included in the scan driver, and transmit the level change signal to a power supply providing a voltage to the level shifter.

7. The display device of claim 1, wherein the gate compensation circuit is configured to:

sense respectively a first gate high voltage and a second gate high voltage for controlling gate electrodes of a first pull-down transistor and a second pull-down transistor included in the scan driver, and change a compensation rate depending on the degree of deterioration of the first pull-down transistor and the second pull-down transistor.

8. A method of driving the display device of claim 1 including the scan driver, the method comprising:

alternately charging a first gate high voltage and a second gate high voltage in the first node controller and the second node controller of the scan driver;

sensing the first node voltage from the first node controller and sensing the second node voltage from the second node controller;

determining the degree of deterioration of a first pull-down transistor and a second pull-down transistor of the pull-down transistors included in the scan driver based on the sensed first node voltage and second node voltage; and charging the turn-on duty ratio of the first node controller to the second node controller depending on the degree of deterioration of the first pull-down transistor and the second pull-down transistor.

9. The method of claim 8, wherein the changing the turn-on duty ratio further comprises:

changing levels of the first gate high voltage and the second gate high voltage depending on the degree of deterioration of the first pull-down transistor and the second pull-down transistor.

10. The method of claim 9, wherein the changing the turn-on duty ratio comprises:

changing at least one of the turn-on duty ratio of the first node controller to the second node controller and a level change rate of the first gate high voltage and the second gate high voltage depending on the degree of deterioration of the first pull-down transistor and the second pull-down transistor.

* * * * *